US005184581A

United States Patent [19]

Aoyama et al.

[11] Patent Number: 5,184,581

[45] Date of Patent: Feb. 9, 1993

[54] VALVE TIMING RETARDING SYSTEM

[75] Inventors: Tateo Aoyama; Kenichi Sakurai; Shigeo Yamamoto, all of Iwata, Japan

[73] Assignee: Yamaha Hatsudoki Kabushiki Kaisha, Iwata, Japan

[21] Appl. No.: 587,999

[22] Filed: Sep. 21, 1990

[30] Foreign Application Priority Data

Sep. 21, 1989 [JP] Japan ..... 1-245671

[51] Int. Cl.[5] ..... F01L 1/02

[52] U.S. Cl. ..... 123/90.31; 123/90.15; 123/90.27

[58] Field of Search ..... 123/90.15, 90.16, 90.17, 123/90.27, 90.31

[56] References Cited

FOREIGN PATENT DOCUMENTS 3534446 4/1987 Fed. Rep. of Germany ... 123/90.31

61-232305 10/1986 Japan ..... 123/90.31

*Primary Examiner*—Noah P. Kamen

*Attorney, Agent, or Firm*—Ernest A. Beutler

[57] ABSTRACT

Several embodiments of variable camshaft timing means for twin overhead cam engines. There is provided a first timing altering means between the engine output shaft and one of the camshafts and a second timing altering means that is operative between the one camshaft and the other camshaft. Both timing altering means are operated by the same hydraulic pressure in several embodiments and a locking device is incorporated so as to avoid self-induced timing adjustment due to the change in driving loads.

30 Claims, 9 Drawing Sheets

VALVE TIMING RETARDING SYSTEM

BACKGROUND OF THE INVENTION

This invention relates to a valve timing retarding system and more particularly to an improved arrangement for adjusting the valve timing between the intake and exhaust valves of an internal combustion engine.

It is well known that the valve timing of an internal combustion engine is highly important in determining the engine performance. In order to achieve maximum power output, relatively large overlaps between the timing of the intake and exhaust valves are desirable. However, such large overlaps tend to deteriorate the performance at lower engine speed. Therefore, it has been proposed to employ a variable timing arrangement wherein the duration of overlap can be changed with minimum overlap being provided at low engine speeds and maximum overlap being provided at wide open throttle. A wide variety of mechanisms have been proposed for this purpose.

Frequently, engines employ twin overhead camshafts with one camshaft serving the function of opening all of intake valves with the other camshaft serving the function opening all of the exhaust valves. When such an arrangement is employed, it is desirable frequently to change the timing of both the intake and the exhaust camshafts relative to the engine output shaft. If a timing adjusting mechanism is employed between the two camshafts, then it is necessary to somehow incorporate this timing adjustment into the chain tensioner or drive mechanism between the two camshafts. Alternatively, it has been proposed to provide separate adjusters between the drive and each camshaft. However, when such separate timing adjusters are provided at the same end of the engine, the construction becomes quite large and complicated.

It is, therefore, a principal object of this invention to provide an improved camshaft drive for a twin camshaft engine wherein the timing relationship of each camshaft may be adjusted and yet a compact drive arrangement and adjusting mechanism is incorporated.

It is a further object of this invention to provide an improved camshaft driving arrangement and timing adjustment mechanism for a twin camshaft internal combustion engine.

It is yet a further object of this invention to provide separately adjustable timing mechanisms for the intake and exhaust camshafts of an engine with the adjusting mechanisms being located at different locations so as to permit a more compact assembly.

Many adjusting mechanisms for the camshaft timing employ hydraulic operators. However, when the camshaft timing is adjusted hydraulically, certain problems can arise. That is, frequently, the hydraulic adjusting mechanism must operate against the driving torque of the camshaft. This means that the hydraulic pressure necessary to accommodate the timing adjustment may vary with the engine load. In some instances, the arrangement can be such that the load itself can overcome the adjusting mechanism and effect an unwanted timing adjustment.

It is, therefore, a further object of this invention to provide an improved timing adjustment mechanism for a camshaft drive including a hydraulic mechanism and wherein adjustment is not permitted except when hydraulic actuation is being experienced.

It is a further object of this invention to provide an improved hydraulic timing adjuster for an internal combustion engine camshaft mechanism that will be self-locking when not being actuated.

SUMMARY OF THE INVENTION

A first feature of this invention is adapted to be embodied in a camshaft arrangement for an internal combustion engine comprising a first camshaft journaled for rotation about a first axis and operating at least one intake valve of a cylinder of the engine. A second camshaft is journaled for rotation about a second axis and operates at least one exhaust valve of the cylinder of the engine. First drive means are provided for driving one of the camshafts from an output shaft of the engine at one end of the one camshaft. The first drive means includes means for changing the timing relationship between the output shaft and the one camshaft. Second drive means drives the other of the camshafts from the one camshaft at a point spaced from the one end of the one camshaft. The second drive means includes means for varying the timing of the other camshaft relative to the one camshaft.

Another feature of the invention is adapted to be embodied in a camshaft drive for an internal combustion engine that includes a driving shaft, a camshaft and drive means for driving the camshaft from the driving shaft. Hydraulically operated means are provided for altering the timing relationship between the driving shaft and the camshaft. Locking means are incorporated for preventing a change in the timing relationship between the driving shaft and the camshaft when hydraulic pressure is not applied to the hydraulically operated means.

DETAILED DESCRIPTION OF THE PREFERRED EMBODIMENTS

Figure 1:
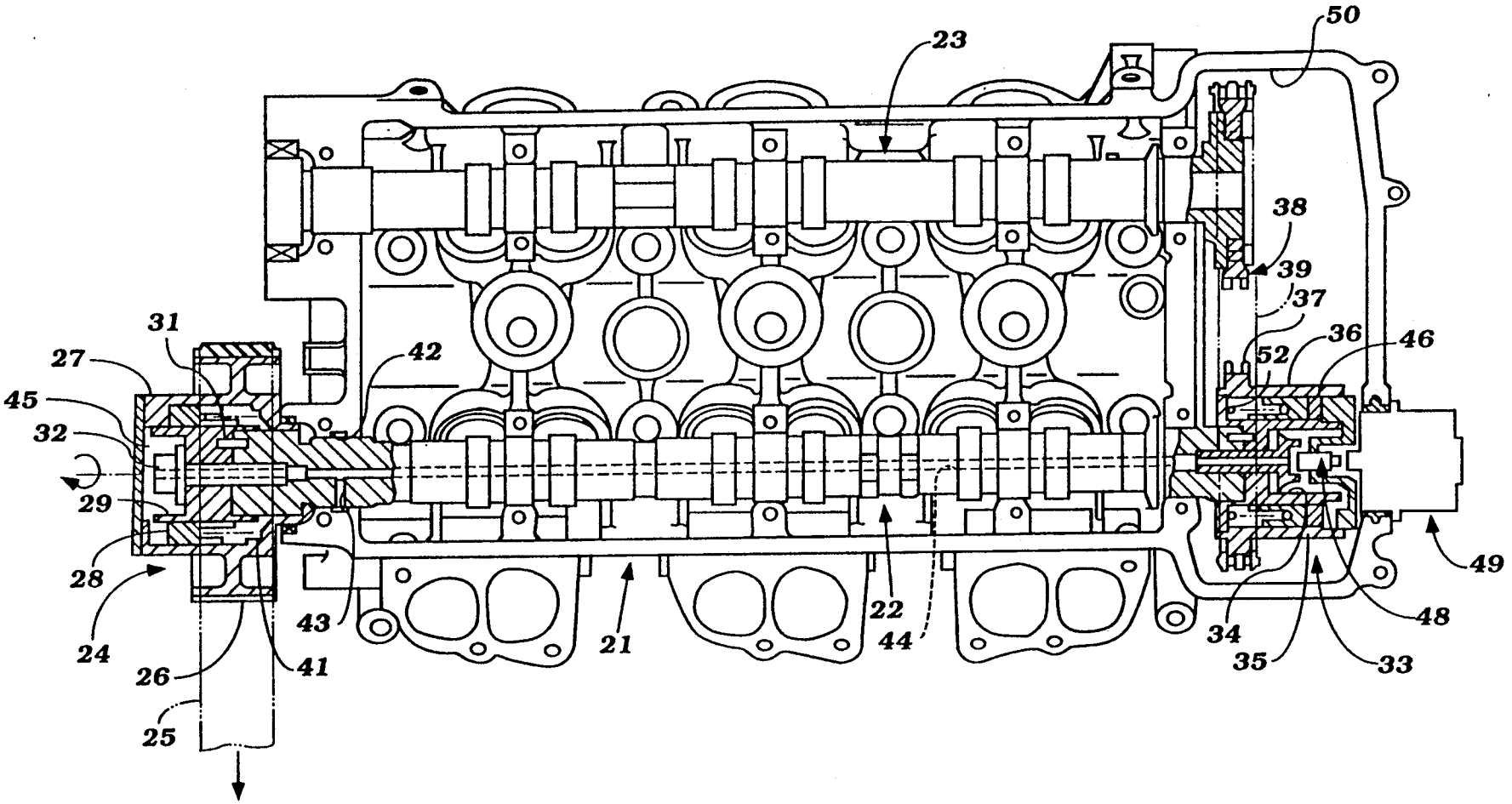
FIG. 1 is a top plan view of the cylinder head assembly of an internal combustion engine constructed in accordance with an embodiment of the invention, with the cam cover removed and portions shown in cross section.
Figure 2:
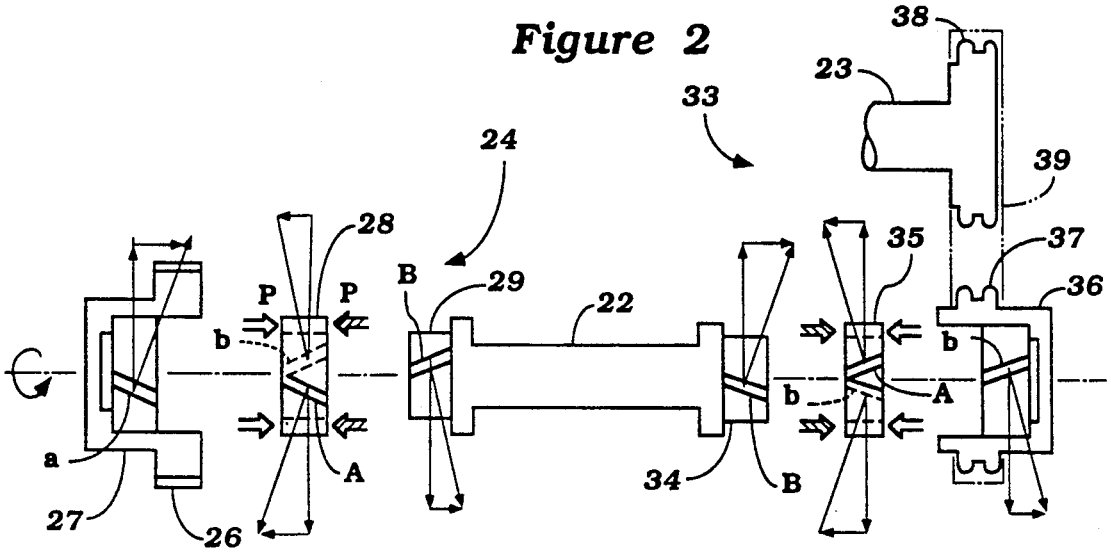
FIG. 2 is a partially exploded view showing the camshaft driving mechanism and arrangement for adjusting the timing.
Figure 11:
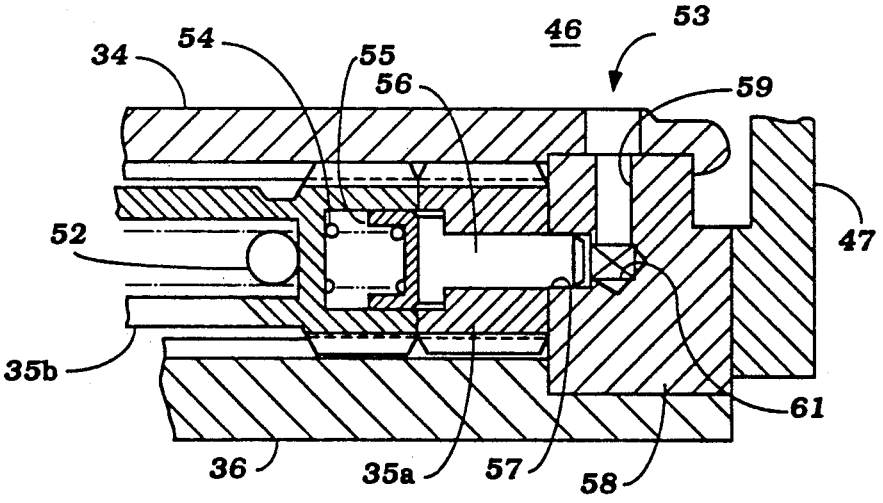
FIG. 11 is an enlarged cross-sectional view showing the locking mechanism for preventing a change in timing adjustment under the circumstance when no hydraulic pressure is applied and is in part similar to FIG. 6.
Figure 3:
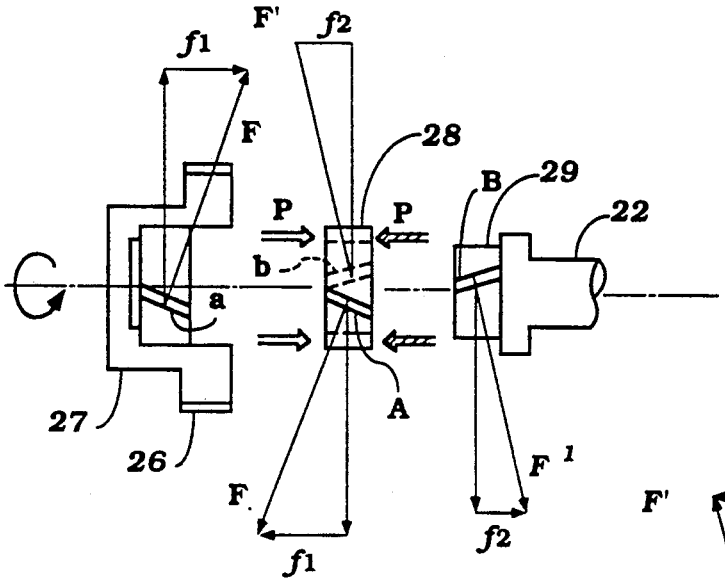
FIG. 3 is a force diagram showing the forces at the left hand side of the camshaft as viewed in FIG. 2.

Referring now in detail to the drawings and initially to the embodiment of FIGS. 1 through 14 and primarily to FIG. 1, a cylinder head of an internal combustion engine is identified generally by the reference numeral 21 and is depicted with the cam cover removed so as to more clearly show the camshaft arrangement. In the illustrated embodiment, the cylinder head 21 is for a three cylinder engine although, as will become apparent by description of later embodiments, the cylinder head 21 also may comprise the cylinder head of one bank of a V type engine. The number of cylinders and configuration of the cylinders is, for the most part, independent of the invention although certain facets of the invention have particular utility with multiple cylinder engines and/or with engines having V or opposed configurations.

Journaled within the cylinder head 21 in any suitable manner are an intake camshaft 22 and an exhaust camshaft 23. The camshafts 22 and 23 are journaled for rotation about parallel axes and each have respective lobes for operating through thimble tappets intake and exhaust valves associated with each of the cylinders of the engine. In the illustrated embodiment, each cylinder has two intake valves and two exhaust valves. Of course, the invention has utility in conjunction with other valve arrangements. Also, since the invention deals primarily with the timing and driving arrangements for the camshafts 22 and 23 and all other portions of the engine ma be considered to be conventional, only the camshaft drive and timing arrangement have been illustrated in any detail.

In accordance with the invention, the intake camshaft 22 is driven by a combined first drive and timing adjusting means, indicated generally by the reference numeral 24. A drive belt 25 is driven in a known manner by the crankshaft (not shown) or other output shaft of the engine and is entrained around a sprocket 26 formed integrally with an outer member 27 of the first drive means and timing adjusting means. An intermediate member 28 has a helically splined connection, to be described, with the sprocket member 27 and also has an internal helically splined portion that is in engagement with an inner member 29 which is, in turn, affixed for rotation with the camshaft 22 in a suitable manner, as by means of a drive pin 31 and axially affixing nut 32.

The first drive means 24 is disposed axially outwardly beyond the end of the intake camshaft 22 at the forward or left hand side of the cylinder 21. In the illustrated embodiment, the camshaft 22 is driven in a clockwise direction when viewed from this front end (from the left).

A second drive and timing adjusting means, indicated generally by the reference numeral 33, is disposed at the rear end of the intake camshaft 22 and includes an inner member 34 that also has a pin connection 35 to the intake camshaft 22 so as to rotate simultaneously with it. An intermediate member 35 has a helically splined connection with the inner member 34 and a similar helically splined connection to an outer or sprocket member 36. The sprocket member 36 has a sprocket portion 37 which is coupled to a driven sprocket 38 carried at the corresponding end of the exhaust camshaft 23 by means of a timing chain 39. In the illustrated embodiment, the intake camshaft 22 is driven from the engine crankshaft by a belt drive and the exhaust camshaft 23 is driven from the intake camshaft 22 by a chain drive. It is to be understood, of course, that various other types of drives including other types of flexible transmitters may be employed.

Figure 12:
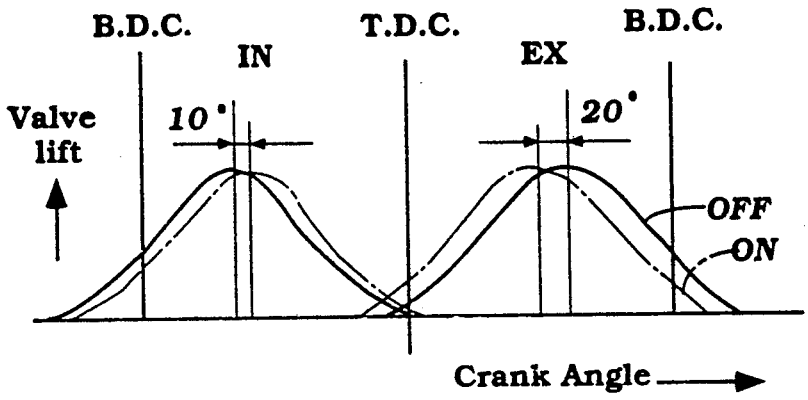
FIG. 12 is a timing diagram showing the effect of change in timing by indicating valve lift relative to crank angle before and after a timing adjustment is effected.
Figure 13:
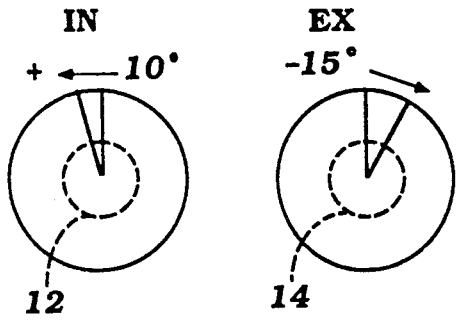
FIG. 13 is an end elevational view of the camshafts showing how the timing is adjusted.

Referring now to FIGS. 2 through 5, the operation of the timing adjusting mechanisms of the first and second drives 24 and 33 will be described. The inner portion of the sprocket 27 is provided with a helical spline a that cooperates with a helical spline A formed on the outer periphery of the intermediate member 28. Hence, when the member 28 is moved axially relative to the sprocket 27 in a direction toward the right, it will be advanced relative to the direction of rotation of the sprocket 27. The intermediate member 28 has an internal spline a that cooperates with an external spline b on the camshaft 22. As a result, when the intermediate member 28 moves to the right, the camshaft 22 will be rotated in an advanced direction relative to the intermediate member. When the intermediate member 28 moves its full stroke from the extreme left hand position, which it is at in normal low speed running conditions, to its extreme right hand position, which it is at under high speed idled conditions, the intake camshaft 22 will be rotated 10° in an advanced direction. Since the camshaft 22 is driven at one-half crankshaft speed, this will amount to a 20° advance in timing of the intake valve events as shown by FIGS. 12 and 13.

Hydraulic pressure is applied, in a manner to be described, to the left hand side of the intermediate member 28 at a pressure P. The intermediate member 28 is normally held at the extreme left hand side of its movement by a return spring 41, FIG. 1, which acts with a biasing force p. In addition to these forces of the hydraulic pressure and the spring, the helical splines a, A and b, B create forces on the intermediate member F and F' which have axial components $F_1$ and $F_2$ that act in cooperation with the spring force p. As a result, the starting hydraulic pressure P necessary to move the intermediate member 28 to the right from its first position to its second position varies with camshaft driving torque as shown in the curve of FIG. 5 and according with the following relationship:

$$P=(F_1+f_2)+P$$

Figure 4:
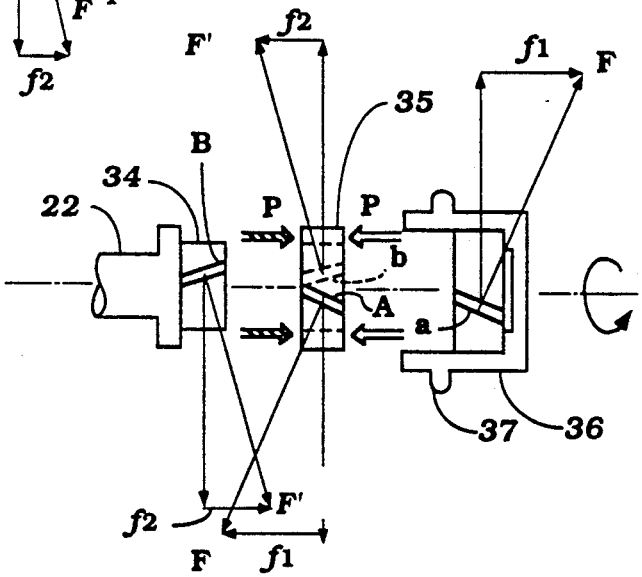
FIG. 4 is a vector diagram showing the forces acting on the right hand side of the camshaft as viewed in FIG. 2.

At the right hand side of the camshaft, the opposite condition prevails. That is, at this end, it is desirable to obtain a retardation in the degree of rotation of the exhaust camshaft and the splined end 34 of the camshaft 22 is the driving member and the sprocket 36 is the driven member. FIG. 4 is a vector diagram showing the condition at this end but the hands of the splines have been reversed and the force diagram assumes that the sprocket 36 is the driving member and the camshaft spline 34 is the driven member for the purposes of illustration. This assumes the same clockwise direction of rotation when viewed from the left or a counterclockwise direction when viewed from the right.

Figure 5:
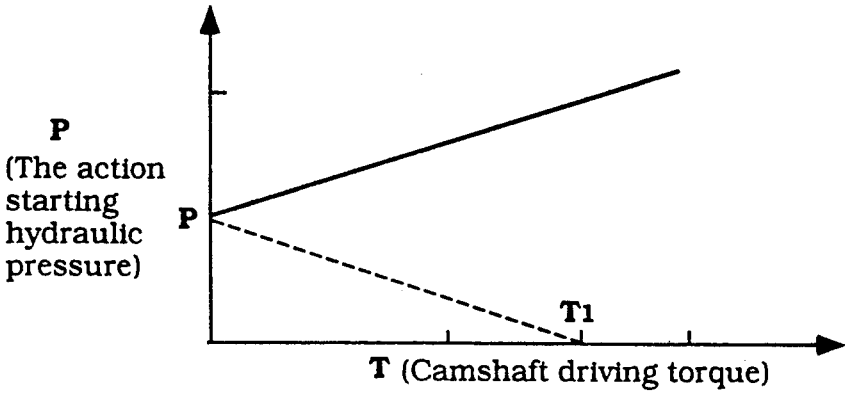
FIG. 5 is a view showing the relationship of the hydraulic pressure required to initiate operation of the hydraulic adjusting mechanism in relation to engine driving torque at the left and right hand sides of the camshaft (solid and broken lines).

In this case, the driving torque tends to cause the intermediate member 35 to move in the same direction that the hydraulic pressure acts in and, hence, the starting pressure curve as shown by the broken line in FIG. 5 assumes the opposite direction. As a result, the actual driving torque can be sufficient at some point to overcome the spring force p and effect a timing adjustment automatically. Of course, this is not desired and in accordance with a feature of the invention, a locking mechanism, as will be described, is incorporated so as to preclude rotation of the intermediate member 35 except under conditions when hydraulic pressure is being applied. This mechanism will be described later by particular reference to FIGS. 6 through 11.

In the illustrated embodiment, the splines B, b and A, a are of a hand that for a given degree of axial movement of the intermediate member 35 from its first position to the extreme right hand side to its second position, to the extreme left hand side, the rotation of the exhaust camshaft 23 will be retarded relative to the rotation of the intake camshaft by 15°. This is a 30° retardation relative to the crankshaft. However, it must be remembered that the intake camshaft has been advanced by 20° hence the total retardation of the exhaust camshaft relative to the intake crankshaft is 10°. This relationship is shown in FIGS. 12 and 13.

Figure 14:
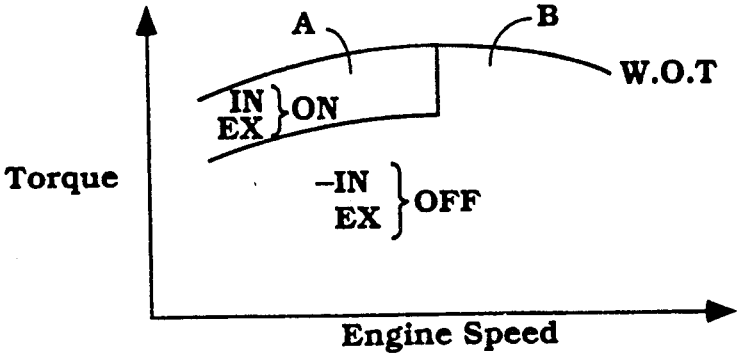
FIG. 14 is a torque curve showing the effect of the timing adjustment on engine torque.

FIG. 14 is a graphical view showing how the torque curve is effected by changing the timing of the camshafts as aforedescribed. Normally at low engine speeds and low loads, the intermediate members 28 and 35 are held in their first positions to the extreme left hand and right hand sides as shown in the Figures and there will be minimum overlap in the valve timing. However, as the engine speed and load increases, then the hydraulic pressure is applied, in the manner to be described, and the timing will be adjusted so as to advance the intake events and retard the exhaust events to provide a greater degree of overlap and greater power. Of course, this would be accomplished with rougher running at low engine speeds and this is why the timing is adjusted only at high engine speeds and loads.

Referring again to FIG. 1, the hydraulic source for actuating the intermediate members 28 and 35 of the drive means 24 and 33 is taken from the lubricating system of the engine. There is provided a gallery in the cylinder head 21 that receives lubricant from the oil pump, which gallery is indicated by the reference numeral 42. This gallery communicates with a cross-drilling 43 formed in the intake camshaft 22 which, in turn, intersects an axially extending passageway 44. The front of this passageway 44 opens into a hydraulic chamber 45 formed between the inner portion of the sprocket 27 and the intermediate member 28.

At the opposite end of the engine, the passageway 44 communicates with a chamber 46 formed between the sprocket 36 and the intermediate member 35. The sprocket 36 is formed with an end plate 47 in which a normally opened valve element 48 is positioned. The valve element 48 normally permits the flow of lubricant from the chamber 45 to a return formed in the chain chamber 50 of the cylinder head 21 and which communicates with the crankcase of the engine. Hence, as long as the normally opened valve 48 is opened, the chambers 45 and 46 will be vented to the return and the intermediate numbers 28 and 35 will not be actuated and will be retained in their first positions.

A solenoid 49 is affixed to the rear of the cylinder head and has a plunger 51 which can be actuated in accordance with a desired strategy so as to urge the valve element 48 from its opened position to a closed position. When this occurs, the chambers 45 and 46 will be pressurized and the intermediate members 28 and 35 will be actuated to their second, timing adjusting positions. The return spring acting on the intermediate member 35 is identified by the reference numeral 52.

As has been previously noted, the driving torque on the camshaft 22 transmitted to the exhaust camshaft 23 can reach a high enough level to overcome the preload of the spring 52 and effect movement of the intermediate member 35 to a timing adjusting position. However, in accordance with the invention, there is provided a locking mechanism, indicated generally by the reference numeral 53 which cooperates with the intermediate member 35 for retaining it in its first position under all conditions when the chamber 46 is not pressurized. To achieve this, the intermediate member 35 is divided into a pair of parts **35*a* and 35*b* as best seen in FIGS. 6 through 11, which are normally urged apart by means of a coil compression spring 54. The spring 54 is received within a bore formed in the member 35*b* and bears against a cup-shaped member 55**.

The cup-shaped member 55 further engages the head of a locking pin 56 that is slidably received within a counterbored portion of the intermediate member part **35*a* and which forces this locking pin 56 into a bore 57 formed in an end plate 58 that is positioned within the sprocket 36 under its end plate 47. A radial bore 59 intersects a small bore 61 formed at the end of the bore 57 so that the bore 57 will receive the same hydraulic pressure that is in the chamber 46**.

The intermediate member 45 also includes, in addition to the locking pin 56, a plurality of aligning headed pins **35*c* that are biased by biasing springs 35*d* when the members 35*a* and 35*b* are put into place so as to maintain a preload to reduce backlash while insuring that the angular position of the portions 35*a* and 35*b*** is maintained constant.

Figure 6:
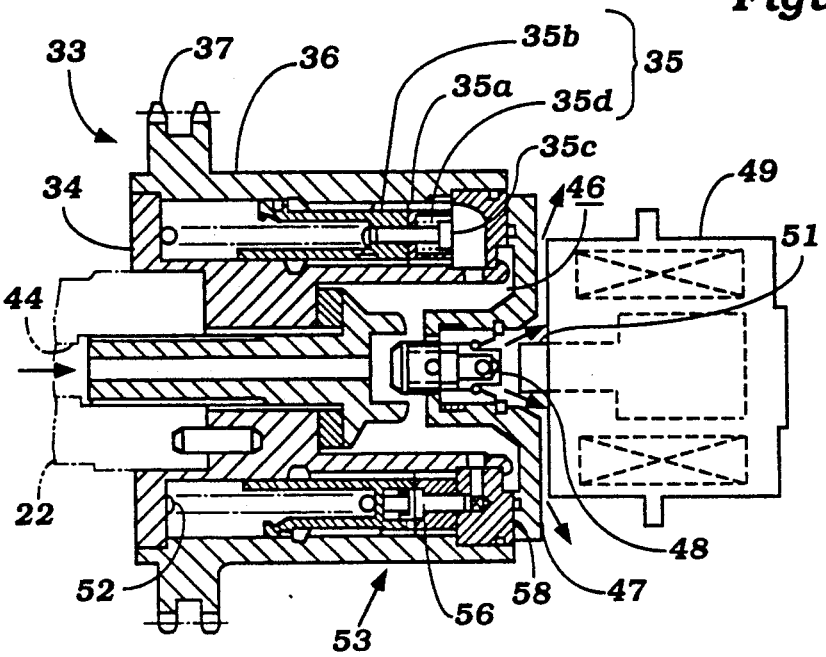
FIG. 6 is an enlarged cross-sectional view taken through the timing adjuster at the right hand side of the camshaft when operating under the condition of no timing adjustment.
Figure 7:
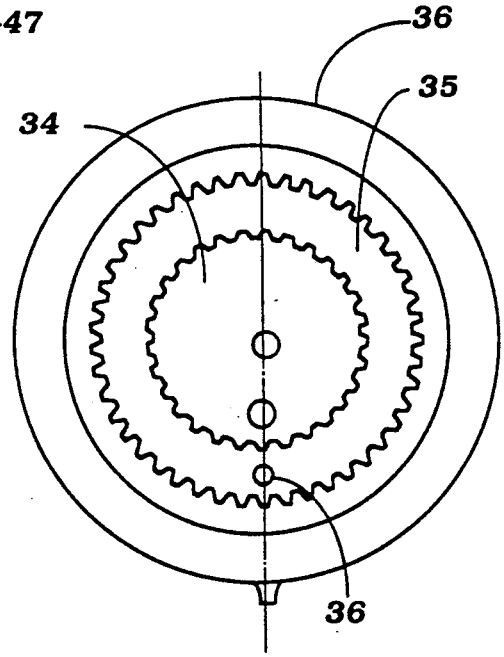
FIG. 7 is an end elevational view of the adjusting mechanism.

The operation of the locking device 53 will now be described by reference to FIGS. 6 through 10. FIGS. 6 and 7 show the condition when the engine is operating at low speeds and the timing adjustment is not being made. Under this condition, the valve 48 will be in its normally opened position and the chambers 45 and 46 associated with the drive mechanism and the adjusting portions thereof will not be pressurized, as aforenoted. Hence, there will be no pressure in the chamber 46 and the locking pin 56 will be held in its aforedescribed position.

Figure 8:
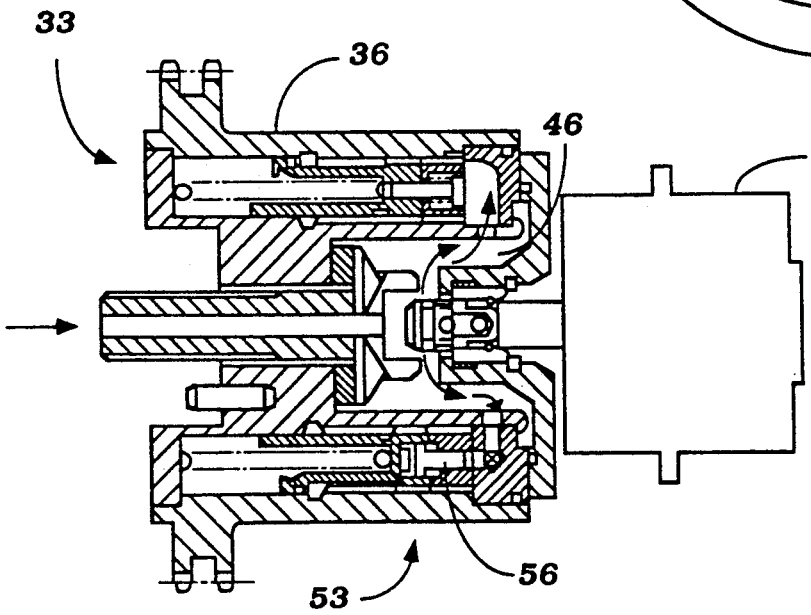
FIG. 8 is a cross-sectional view, in part similar to FIG. 6, and shows the condition at the initiation of the effecting of an adjustment in camshaft timing.
Figure 9:
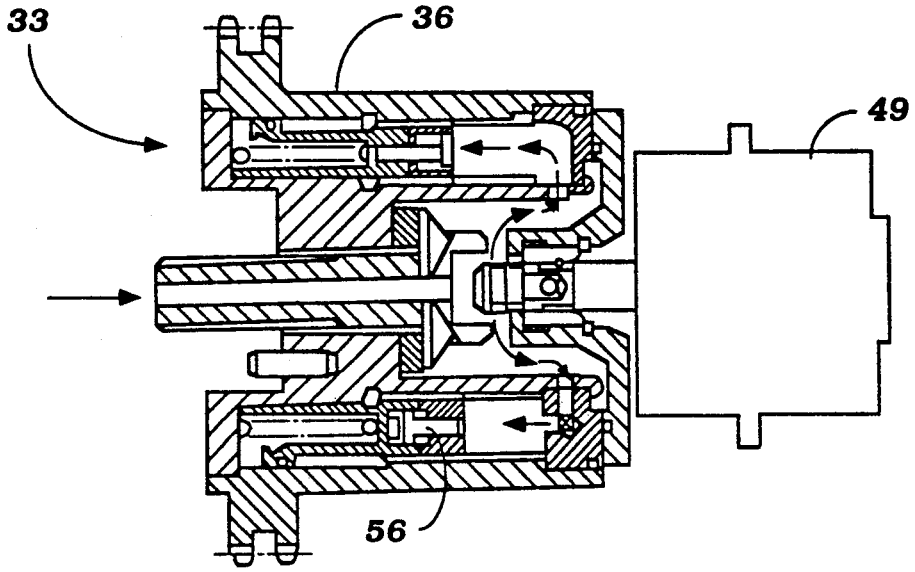
FIG. 9 is a cross-sectional view, in part similar to FIGS. 6 and 8, showing the position at the completion of a timing adjustment.
Figure 10:
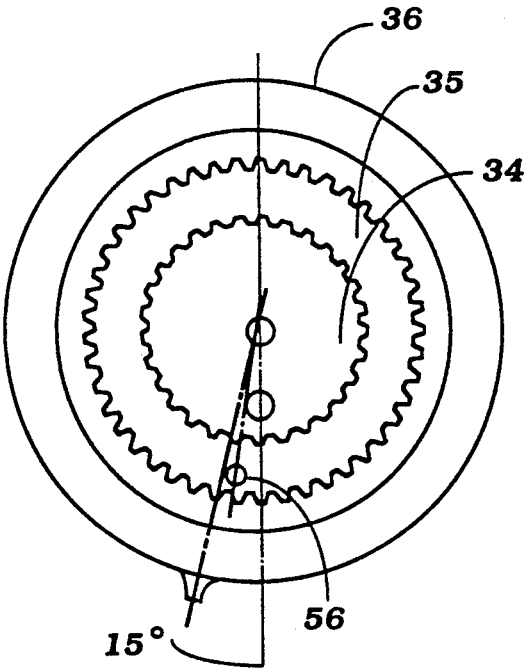
FIG. 10 is an end elevational view, in part similar to FIG. 7, showing the mechanism after the timing adjustment has been effected.

However, once the solenoid 49 is energized and the plunger 51 engages the valve 48, pressure will begin to build up in the chamber 46 (FIG. 8). When this occurs, the locking pin 56 will be urged away from its position in the bore 57 against the action of the spring 54. It should be noted that the spring 54 exerts a substantially lower pressure than the spring 52. Hence, the locking pin 56 will be released before there is sufficient pressure in the chamber 46 so as to effect axial movement of the intermediate member 35.

However, once the pressure increases sufficiently, the intermediate member 35 will be urged by the hydraulic pressure to the timing adjusting second position (FIGS. 9 and 10) so that the sprocket 36 will be rotated 15° relative to the camshaft portion 34 so as to achieve the aforenoted retardation of the exhaust valve opening and closing to provide the aforenoted overlap. Therefore, the device operates so that the driving torque will not inadvertently effect a timing adjustment. Said another way, the timing adjustment will only be effected when there is hydraulic pressure exerted in the chamber 46. When the hydraulic pressure is released, the device will return to the position shown in FIGS. 6, 7 and 11.

Figure 15:
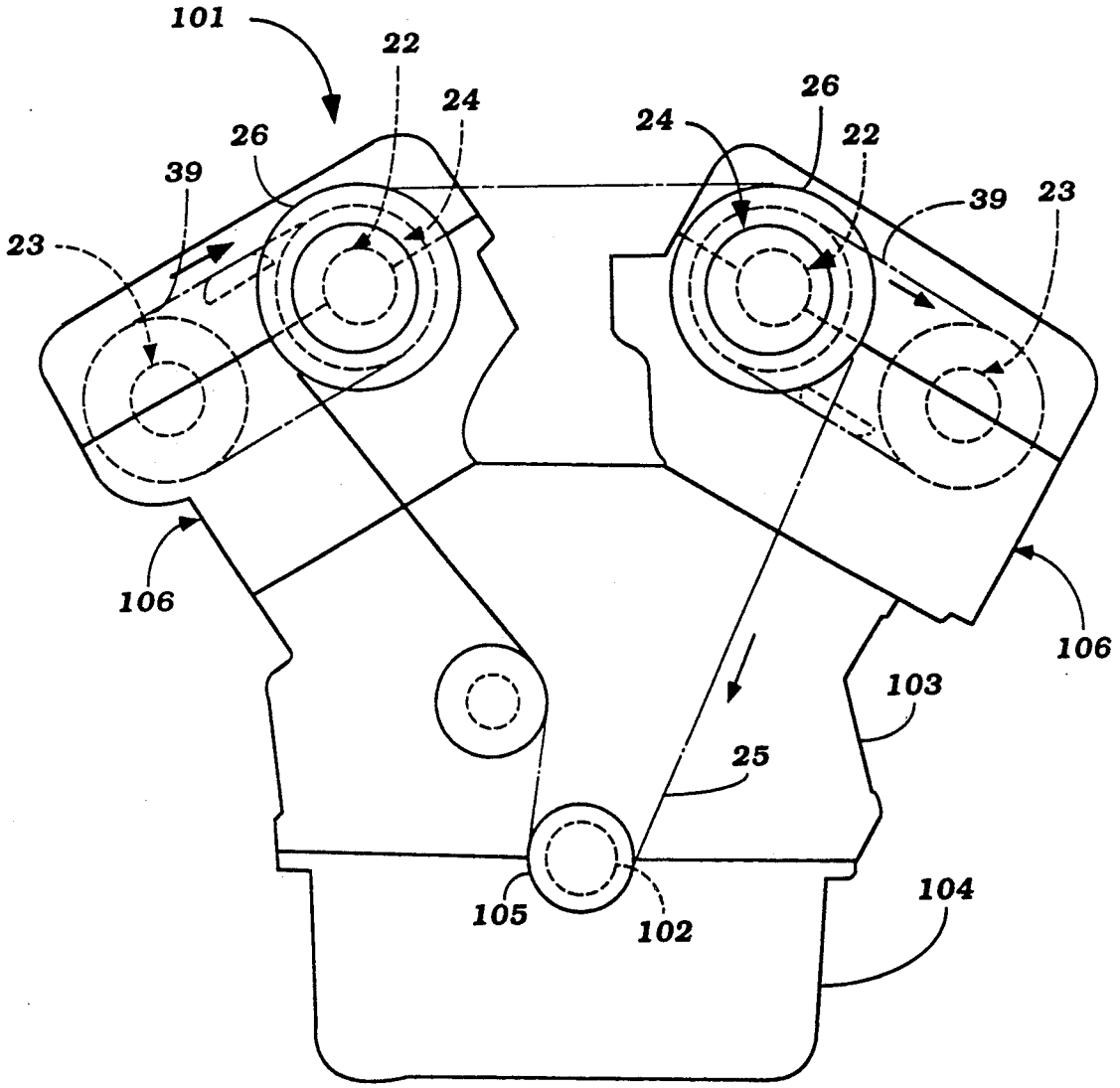
FIG. 15 is a front elevational view showing the application of the invention to a V type engine.
Figure 16:
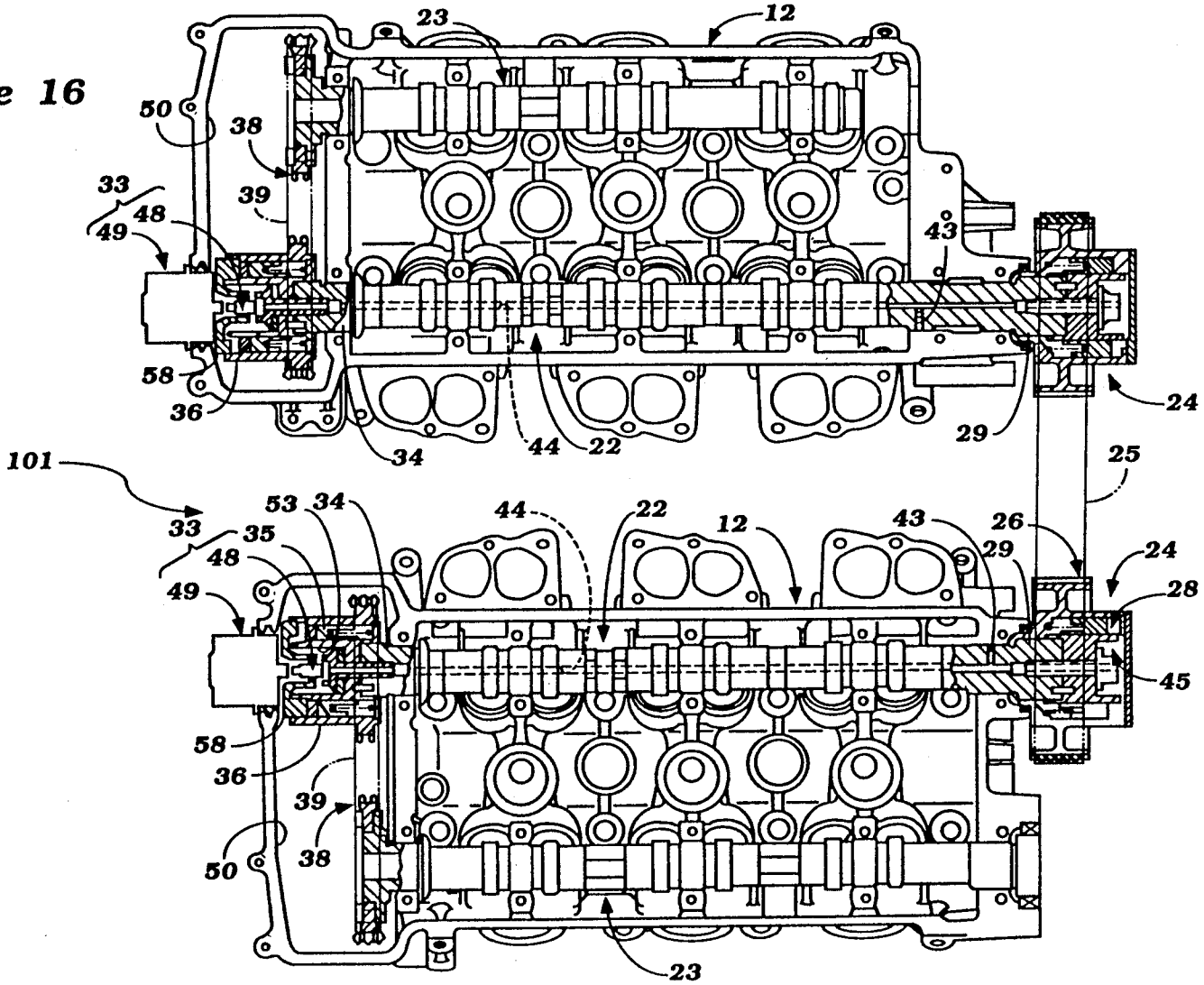
FIG. 16 is a top plan view of this embodiment, with the cam covers removed.

In the embodiment of the invention as thus far described, the mechanism has been discussed in conjunction with an inline twin overhead cam engine. As has been aforenoted, the invention can also be practiced in conjunction with other types of engine arrangements and FIGS. 15 and 16 show an embodiment, indicated generally by the reference numeral 101, wherein the invention is employed in conjunction with a V type engine. In the specific embodiment illustrated, the V type engine is a V6 engine. As should be readily apparent, the invention can be practiced with V engines of other cylinder numbers and also engines having a wide variety of angles between the cylinder banks including opposed engines. In this embodiment, the engine crankshaft 102 is journaled between a cylinder block 103 and a crankcase pan 104 in a known manner. The exposed forward end of the crankshaft 102 has affixed to it a toothed pulley 105 that drives the drive belt 25.

The cylinder block 103 defines a pair of opposed cylinder banks tó which cylinder heads 106 are attached. The cylinder head 106 of the left bank of the engine will have a construction exactly that of the embodiment of FIG. 1 and, for this reason, those components which are the same as the previously described embodiment have been identified by the same reference numerals and further description is believed to be unnecessary. The cylinder block of the right hand bank has a construction the same as that of FIG. 1, however, in this instance, the intake camshaft and the exhaust camshaft are reversed. In this way, both intake camshafts will be positioned on the side of the engine toward the valley of the V. In this embodiment, each exhaust camshaft of each cylinder bank is driven by a drive mechanism like the drive mechanism 33 and, because of this similarity, further description of this construction is also believed to be unnecessary to enable those skilled in the art to practice the invention. Because of these similarities, all similar components have been identified by the same reference numerals and will not be described again.

Figure 17:
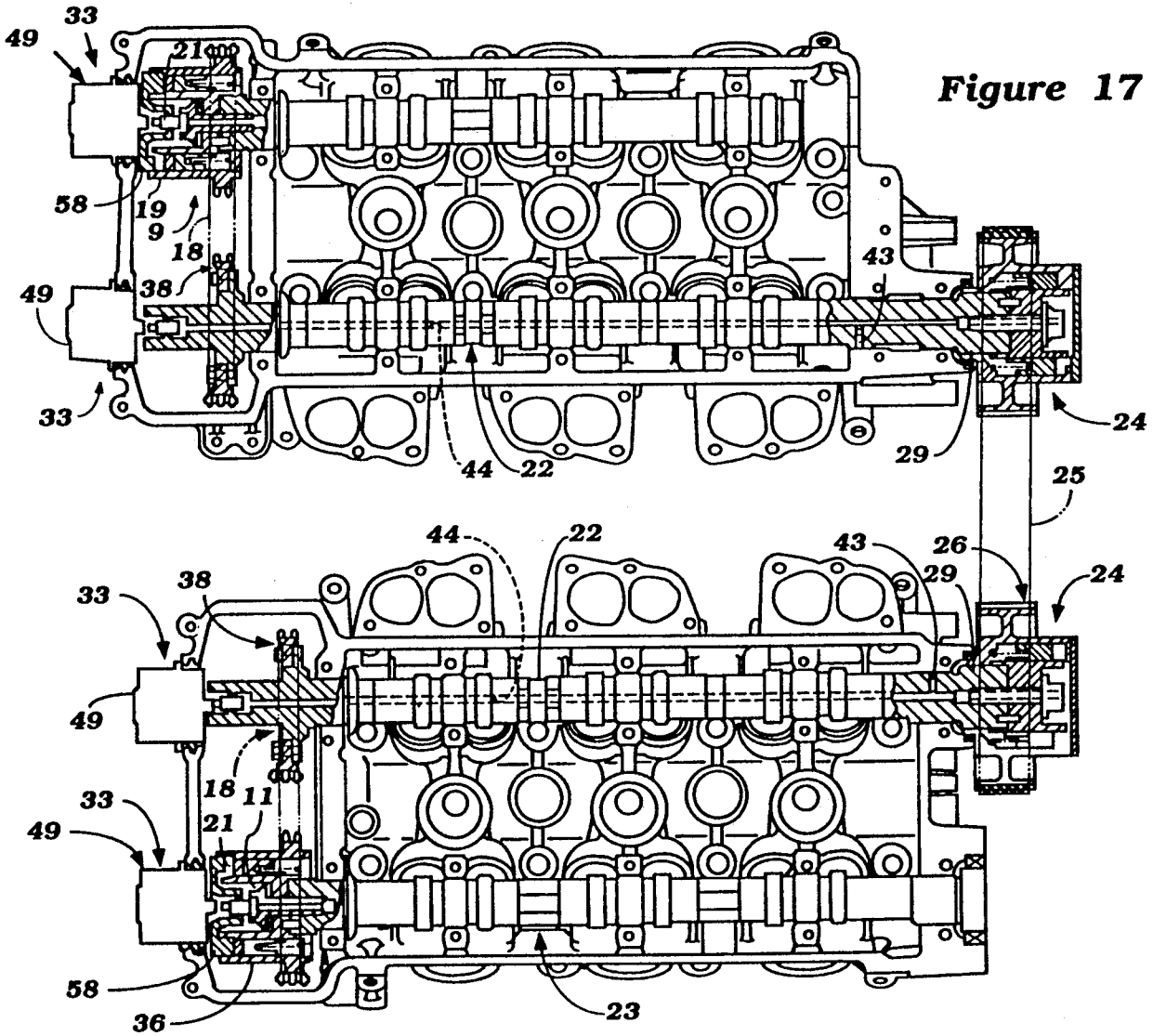
FIG. 17 is a top plan view, in part similar to FIGS. 6 and 17, and shows a third embodiment of the invention.

In the embodiments of the invention as thus far described, both of the timing adjusting devices have been located on the same camshaft. This has the advantage of simplifying the hydraulic circuitry and also making it only necessary to employ one valve for controlling the timing adjustment. However, it may, if desired, be possible to provide the timing adjusting devices each on a respective one of the camshafts. It is desirable to provide a compact arrangement when this is done and FIG. 17 shows such an embodiment.

It will be noted that the timing mechanism between the intake and exhaust camshaft is in this embodiment relocated to the exhaust camshaft but is disposed at the end opposite the engine from the drive between the crankcase and the intake camshafts. However, both of the solenoids 49 and the control valves are located at the same end of the engine so as to facilitate control. In all other regards this embodiment is the same as the previously described embodiments and, for that reason, the same components have been identified by the same reference numerals and will not be described again.

It should be readily apparent from the foregoing description that the described embodiments are well fitted to provide an improved camshaft arrangement having a timing control that permits adjustment of the timing of both of the intake and exhaust camshafts and still provides a very compact assembly. In addition, a mechanism is incorporated for insuring that the device will not self-adjust when hydraulic pressure is not being applied. Although the foregoing description is that of preferred embodiments of the invention, it should be readily apparent to those skilled in the art that various changes and modifications may be made without departing from the spirit and scope of the invention, as defined by the appended claims.

We claim:

1. A camshaft arrangement for an internal combustion engine comprising a first camshaft journaled for rotation about a first axis and operating at least one intake valve of a cylinder of said engine, a second camshaft journaled for rotation about a second axis and operating at least one exhaust valve of said cylinder of said engine, a first drive element carried by said first camshaft at one end therefore, first positive drive means for driving said first drive element in timed relation from an output shaft of said engine, first variable timing means for driving said first camshaft from said first drive element and changing the timing relationship between said output shaft and said first camshaft, a second drive element carried at a point spaced from said one end of said first camshaft, second variable timing means for driving said second drive element from said first camshaft and for varying the timing of said second drive element relative to said first camshaft, and second positive drive means for driving said second camshaft in timed relation to said second drive element.

2. A camshaft arrangement as set forth in claim 1 wherein the second drive means is located at the other end of the one camshaft.

3. A camshaft arrangement as set forth in claim 2 wherein at least one of the drive elements comprises a toothed sprocket and the respective positive drive means includes a flexible transmitter.

4. A camshaft arrangement as set forth in claim 1 wherein both of the drive element comprises toothed sprockets and each of the positive drive means comprise flexible transmitters.

5. A camshaft arrangement as set forth in claim 1 wherein the engine is a V type engine having a first and second cylinder bank each with first and second camshafts, the first camshafts of each cylinder bank being driven by the first drive means and the second camshafts of each cylinder head each being driven from the one camshaft of each cylinder head by one of a pair of second drive means.

6. A camshaft arrangement as set forth in claim 1 wherein both of the variable timing adjusting means are hydraulically operated.

7. A camshaft arrangement as set forth in claim 6 further including a single control valve for controlling the application of hydraulic pressure to both of the variable timing adjusting means.

8. A camshaft arrangement for an internal combustion engine comprising a first camshaft journaled for rotation about a first axis and operating at least one intake valve of a cylinder of said engine, a second camshaft journaled for rotation about a second axis and operating at least one exhaust valve of said cylinder of said engine, first drive means for driving one of said camshafts from an output shaft of said engine at one end of said one camshaft, said first drive means including means for changing the timing relationship between said output shaft and said one camshaft, second driving means for driving the other of said camshafts from said one camshaft at the other end of said one camshaft, said second drive means including means for varying the timing of said other camshaft relative to said one camshaft, at least one of said drive means including a flexible transmitter, the means for varying the timing of at least one of said drive means includes means for effecting rotation of that camshaft relative to the driving element, means for varying the timing of the one camshaft including a hydraulically operated element, and looking means for precluding movement of said hydraulically operated element when hydraulic pressure is not applied so as to avoid self-adjusting.

9. A camshaft arrangement as set forth in claim 8 wherein the locking means is also hydraulically operated and is released hydraulically when pressure is applied to the hydraulically operated element.

10. A camshaft arrangement for an internal combustion engine comprising a first camshaft journaled for rotation about a first axis and operating at least one intake valve of a cylinder of said engine, a second camshaft journaled for rotation about a second axis and operating at least one exhaust valve of said cylinder of said engine, first drive means for driving one of said camshafts from an output shaft of said engine at one end of said one camshaft, said first drive means including means for changing the timing relationship between said output shaft and said one camshaft, second driving means for driving the other of said camshafts from said one camshaft at the other end of said one camshaft, said second drive means including means for varying the timing of said other camshaft relative to said one camshaft, at least one of said drive means including a flexible transmitter, means for varying the timing of at least one of the drive means includes means for effecting rotation of that camshaft relative to the driving element, both of the means for varying the timing being hydraulically operated and the means for varying the timing of said one camshaft including a hydraulically operated element, and a single control valve for controlling the application of hydraulic pressure to both of the timing adjusting means.

11. A camshaft arrangement as set forth in claim 10 wherein the single control valve controls the pressure in a fluid passage extending through the one camshaft.

12. A camshaft arrangement as set forth in claim 11 further including locking means for precluding movement of the hydraulically operated element of one of the timing adjusting means when hydraulic pressure is not applied so as to avoid self-adjusting.

13. A camshaft arrangement for an internal combustion engine comprising a first camshaft journaled for rotation about a first axis and operating at least one intake valve of a cylinder of said engine, a second camshaft journaled for rotation about a second axis and operating at least one exhaust valve of said cylinder of said engine, first drive means for driving one of said camshafts from an output shaft of said engine at one end of said one camshaft, said first drive means including means for changing the timing relationship between said output shaft and said one camshaft, second driving means for driving the other of said camshafts from said one camshaft at the other end of said one camshaft, said second drive means including means for varying the timing of said other camshaft relative to said one camshaft, at least one of said drive means including a flexible transmitter, the means for varying the timing of said one camshaft includes a hydraulically operated element, and locking means for precluding movement of said hydraulically operated element when hydraulic pressure is not applied so as to avoid self-adjusting.

14. A camshaft arrangement as set forth in claim 13 wherein the locking means is also hydraulically operated and is released hydraulically when pressure is applied to the element.

15. A camshaft arrangement a set forth in claim 14 wherein both of the timing means are hydraulically operated.

16. A camshaft arrangement as set forth in claim 15 further including a single control valve for controlling the application of hydraulic pressure to both of the timing adjusting means.

17. A camshaft arrangement as set forth in claim 16 wherein the single control valve controls the pressure in a fluid passage extending through the one camshaft.

18. A camshaft arrangement for an internal combustion engine having first and second cylinder banks disposed at a V, a pair of first camshafts journaled for rotation about respective first axes relative to a respective one of said cylinder banks and operating at least one intake valve in said respective bank, a pair of second camshafts journaled for rotation about respective second axes relative to said cylinder banks and each operating at least one exhaust valve of a cylinder of said respective cylinder bank, first drive means for driving one of said camshafts of each of said cylinder banks from an output shaft of said engine at one end of said one camshafts, said first drive means including means for changing the timing relationship between said output shaft and said one camshafts, a pair of second driving means for driving the other of said camshafts from said one camshaft of each of said cylinder banks, each of said pair of second drive means including means for varying the timing of said other camshaft relative to said one camshaft, said pair of second drive means being located at the other end of the respective one camshaft.

19. A camshaft arrangement as set forth in claim 18 wherein the means for varying the timing of at least one of the drive means includes means for effecting rotation of that camshaft relative to the driving element.

20. A camshaft arrangement as set forth in claim 19 wherein all of the timing adjusting means are hydraulically operated.

21. A camshaft arrangement as set forth in claim 20 wherein there is a single valve for each cylinder bank for controlling the hydraulic actuation thereof.

22. A camshaft arrangement as set forth in claim 21 further including locking means for precluding movement of the hydraulically operated element when hydraulic pressure is not applied so as to avoid self-adjusting.

23. A camshaft drive for an internal combustion engine comprising a driving shaft, a camshaft, drive means for driving same camshaft from said driving shaft, hydraulically operated means for altering the timing relationship between said driving shaft and said camshaft, and locking means for precluding a change in the timing relationship between said driving shaft and said camshaft when hydraulic pressure is not applied to said hydraulically operated means.

24. A camshaft drive as set forth in claim 23 wherein the hydraulically operated means comprises a reciprocally supported member.

25. A camshaft drive as set forth in claim 24 wherein the locking means precludes movement of said reciprocal member.

26. A camshaft drive as set forth in claim 25 wherein the locking means is released by the same hydraulic pressure that is applied to the reciprocally supported member.

27. A camshaft drive as set forth in claim 23 wherein the driving shaft comprises another camshaft driven by an engine output shaft.

28. A camshaft drive as set forth in claim 27 further including second hydraulically operated means for varying the timing relationship between said other camshaft and the engine output shaft.

29. A camshaft drive as set forth in claim 28 wherein the same hydraulic pressure source is utilized for operating both of the timing altering means.

30. A camshaft drive as set forth in claim 29 wherein the timing altering means are disposed at opposite ends of the one camshaft.

* * * * *